US005809589A

United States Patent [19]

Johnson

[11] Patent Number: 5,809,589

[45] Date of Patent: Sep. 22, 1998

[54] SHOWER CURTAIN RETAINER

[76] Inventor: Robert E. Johnson, 110 4th St., Dearborn Heights, Mich. 48127

[21] Appl. No.: 893,017

[22] Filed: Jul. 15, 1997

[51] Int. Cl.[6] ..... A47K 3/14

[52] U.S. Cl. ..... 4/609; 4/610; 4/558; 4/608; 160/349.2; 160/DIG. 6

[58] Field of Search ..... 4/557, 558, 607, 4/608, 610, 609; 160/349.1, 349.2, 330, DIG. 6

[56] References Cited

U.S. PATENT DOCUMENTS

| | | | |
|---|---|---|---|
| 1,047,842 | 12/1912 | Rycroft | 160/330 |
| 1,833,298 | 11/1931 | Oakey | 160/349.1 |
| 2,107,421 | 2/1938 | Lennox | 160/349.1 |
| 2,232,194 | 2/1941 | Zogby | 4/558 |
| 2,293,883 | 8/1942 | Bossert | 160/349.2 |
| 3,585,674 | 6/1971 | Golden | 160/330 |
| 4,594,741 | 6/1986 | Payne | 4/558 |
| 5,097,541 | 3/1992 | Annand | 4/558 |
| 5,421,393 | 6/1995 | Wolfe | 4/558 |

*Primary Examiner*—Charles R. Eloshway
*Attorney, Agent, or Firm*—Patent & Trademark Services, Inc.; Joseph H. McGlynn

[57] ABSTRACT

A shower curtain retaining device which will hold the curtain away from the person using the shower. It has a pair of attachments which are secured to the adjacent portions of a shower stall or bath tub enclosure and to which are attached a sleeve containing a spring. A line is attached at one end to the spring and the other end of the line is attached to one of the attachments, thus providing a device which can be attached adjacent the inside of the curtain and retain the curtain away from a person using the shower.

4 Claims, 1 Drawing Sheet

SHOWER CURTAIN RETAINER

BACKGROUND OF THE INVENTION

This invention relates, in general, to shower curtains, and, in particular, to a retainer which holds the curtain away from the person using the shower.

DESCRIPTION OF THE PRIOR ART

In the prior art various types of curtain retainers have been proposed. For example, U.S. Pat. No. 2,232,194 discloses a bath curtain holding device which utilizes suction cups attached to a horizontal bar to retain the lower edge of the curtain against the inside of the bathtub.

U.S. Pat. No. 4,594,741 discloses a retaining device which holds the vertical edges of a shower curtain against the adjacent vertical portions of a shower stall by means of a two part elongated strip magnet. One of the parts is attached to the shower curtain and the other part is attached to the shower stall.

U.S. Pat. No. 5,097,541 discloses a shower curtain holding device comprising rod-like elements which are attached to the shower curtain hooks and extend down the inside of the curtain.

U.S. Pat. No. 5,421,393 discloses a shower curtain holding device for the lower horizontal edge of the curtain which comprises a stiffened rib member which is attached to the lower edge of the curtain which prevents the curtain from curling inward.

While the prior art devices perform their intended purposes, none of the prior art devices are simple to operate and can be easily attached or detached. In addition, most of the prior art devices are complicated and require special element which must be attached permanently or semi-permenantly to the curtain. This feature of the prior art devices make it inconvenient when the shower curtain must be replaced.

The present invention is designed to overcome the disadvantages of the prior art devices.

SUMMARY OF THE INVENTION

The present invention comprises a shower curtain retaining device which will hold the curtain away from the person using the shower. It has a pair of attachments which are secured to the adjacent portions of a shower stall or bath tub enclosure and to which are attached a sleeve containing a spring. A line is attached at one end to the spring and the other end of the line is attached to one of the attachments, thus providing a device which can be attached adjacent the inside of the curtain and retain the curtain away from a person using the shower.

It is an object of the present invention to provide a new and improved shower curtain retainer.

It is an object of the present invention to provide a new and improved shower curtain retainer which is not permanently attached to a shower curtain.

It is an object of the present invention to provide a new and improved shower curtain retainer which can be installed on any existing shower or bath tub enclosure.

It is an object of the present invention to provide a new and improved shower curtain retainer which can be portable and taken with a person while traveling.

These and other objects and advantages of the present invention will be fully apparent from the following description, when taken in connection with the annexed drawings.

DESCRIPTION OF THE PREFERRED EMBODIMENT

Figure 1:
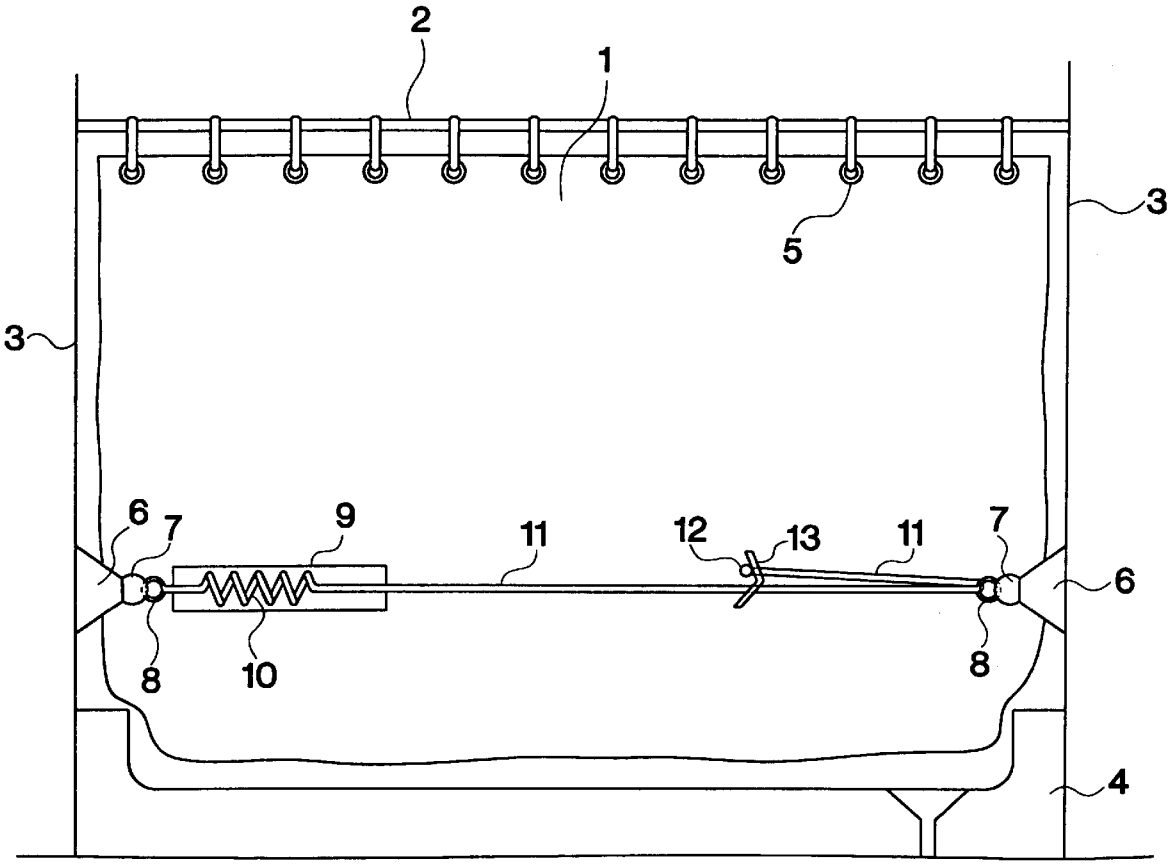
FIG. 1 is a view of the present invention showing the retainer installed on the inside of a shower curtain.

Referring now to the drawings in greater detail, FIG. 1 shows the present invention installed on the inside of a typical shower curtain 1. The curtain is suspended from a conventional shower curtain rod 2 by means of curtain hooks 5. The curtain is hung between walls 3 to cover a tub 4 or shower stall.

In order to keep the curtain 1 away from the person using the shower, the device of the present invention will be attached to the walls 3 near the bottom of the curtain. The preferred means of attachment to the walls is a pair of suction cups 6 which are secured to opposite walls. The use of suction cups allows the device to be portable so a person can take it along while traveling to use in hotel or motel bathrooms. Other conventional types of attachments such as, but not limited to, hooks could be used if a permanent installation were desired.

Attached to each suction cup 6 is a permanently mounted ring 7 which is attached to the suction cup by any conventional means. On one end (the left end as shown in FIG. 1) a second ring 8 is attached to the first ring 7. Attached to the second ring 8 is a spring 10 which is contained within a sleeve 9. A flexible line 11 is attached to the spring 10 and extends out of the sleeve 9. The line is passed through a second ring 8 on the right end as shown in FIG. 1, which is attached to a ring 7 secured to a second suction cup 6.

After the line passes through the ring 8 on the right side, it continues on and has an enlargement 12 affixed to its end by any conventional means. Also attached to this end of the line is a clip 13 for a purpose to be described below.

Figure 2:
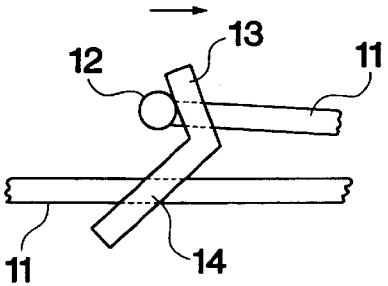
FIG. 2 is a side view of the holding clip used with the present invention.

When a person desires to take a shower, he/she will attach the suction cups 6 to the walls (if they are not already attached). The end of the line with the enlargement will be pulled toward the sleeve 9 until the line is taut. The V-shaped clip 13 has an aperture 14 which is slightly larger than the line 11 and through which the line 11 extends. When the person releases the line, after it is pulled taut, the spring will pull the line back in the direction of the arrow in FIG. 2. this will cause the upper portion of the clip to be pulled in the direction of the arrow, which in turn will cause the lower portion of the clip to pivot clockwise about the line 11. This will cause the upper portion of the aperture 14 in the clip 13 to engage the top of the line 11, on the right side of the clip, and the lower portion of the aperture 14, on the left side of the clip, to engage the bottom of the line 11. This engagement of the clip with the line will hold the line in the position it is placed. This holding clip will allow the device to be used in different sizes of bath tubs or showers.

Although the Shower Curtain Retainer and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A holding device for a bathing enclosure having walls on opposite sides of the enclosure, and having a curtain extending across the enclosure, the holding device comprising:

a first removable holding means for securing said device to one wall and a second holding means for securing said device to an opposite wall, said first holding means being attached to a spring at one end of said spring, a line attached at one end to another end of said spring, said line being slidably attached to said second holding means, whereby when said device is attached inside a shower curtain, the shower curtain will be held away from a person using the shower, and wherein the other end of said line has a V-shaped clip attached thereto said clip further being slidably attached to an intermediate portion of said line for allowing lengthwise adjustment of said line relative to said another end of said spring and said second holding means.

2. The holding device as claimed in claim 1, wherein a sleeve surrounds said spring.

3. The holding device as claimed in claim 1, wherein said first and second holding means are suction cups.

4. The holding device as claimed in claim 1, wherein said V-shaped clip comprises a first arm and a second arm, said first arm being attached to the other end of said line, and said second arm having an aperture therein, said aperture engaging said intermediate portion of said line at locations between said another end of said spring and said second holding means, said V-shaped clip being movable from a first location to at least a second location along said line, and said aperture engaging said line when said V-shaped clip is in said first and second locations to adjust the length of said line.

* * * * *